United States Patent [19]

Lee

[11] 4,253,909

[45] Mar. 3, 1981

[54] SURFACE TREATING A PORTION OF SMALL ARTICLES

[75] Inventor: Lawrence L. Lee, Fort Wayne, Ind.

[73] Assignee: Magnavox Government and Industrial Electronics Co., Fort Wayne, Ind.

[21] Appl. No.: 675,859

[22] Filed: Apr. 12, 1976

[51] Int. Cl.[3] ..... B44C 1/22

[52] U.S. Cl. ..... 156/654; 427/47; 427/256

[58] Field of Search ..... 427/47, 48, 127–132, 427/256; 156/654

[56] References Cited

U.S. PATENT DOCUMENTS

| | | | |
|---|---|---|---|
| 265,475 | 10/1882 | Waters | 427/430 X |
| 1,407,067 | 2/1922 | Johnson | 427/47 |
| 1,420,306 | 6/1922 | Gigol et al. | 427/430 X |
| 2,370,636 | 3/1945 | Carlton | 427/47 |
| 2,418,479 | 4/1947 | Pratt et al. | 427/47 |
| 3,676,253 | 7/1972 | Cox | 427/47 |
| 3,938,263 | 2/1976 | Tate | 346/135 |

*Primary Examiner*—Bernard D. Pianalto

*Attorney, Agent, or Firm*—William J. Iseman; William J. Streeter; T. A. Briody

[57] ABSTRACT

A method for coating, etching, or coloring a portion of the surface of small articles wherein a plurality of the small articles are supported mainly by the surface tension of the interface between air and a liquid containing a desirable coating, etching, or coloring solution. The small articles are then removed from the solution with the result being that only the portion of the article in contact with the solution becomes treated. The size of the portion of the surface of the small article to be treated can be controlled by adding surfactants to the solution to vary the surface tension.

18 Claims, 4 Drawing Figures

SURFACE TREATING A PORTION OF SMALL ARTICLES

BACKGROUND OF THE INVENTION

The present invention relates to a method for surface treating a portion of the surface of a small article. More particularly, the present invention relates to an improved method for coating, etching, or coloring a portion of a small spherical article by substantially supporting the small spherical article by the surface tension of the treating solution.

Many small spherical particles are required for the manufacture of a magnetic particle display panel disclosed in my copending patent application Ser. No. 566,455, filed Apr. 9, 1975 and now abandoned which is incorporated herein by reference. These spherical particles might range from approximately 10 microns to the order of 200 microns in diameter depending upon the desired resolution of the display panel. It is desirable to have the small spherical particles reflect a different color from a portion of the particle than from other portions of the particle in order to provide contrast in the presentation of the display panel.

One possible method to coat or color one area of a spherical particle would be to spray that area of the particle from a fixed position with relationship to the particle. The spherical particle would serve as a mask for the remainder of the particle and only the portion of the particle facing the sprayer would be coated. However, such a method is not satisfactory for a particle useable in the display panel because of the gradual transition from the coated portion to the uncoated portion. For applications in the magnetic particle display panel, it is desirable for the different coated or colored portions to have a clear and precise separation of colored areas. In the past, many different approaches have been proposed for coating or coloring one area of an article. One such method proposes placing the article on an adhesive tape and then spraying the exposed area of the article. This method is very satisfactory for certain articles that tend to be flat, however, it is not satisfactory for spherical particles because once again the transition area between the portion coated and the portion that is uncoated is not sharply defined. Another method proposed in the past is to dip an article to be coated into a coating solution. The article can be hand held or hung from a conveyor while the article is dipped in and out of the coating solution. This method seems to work well for large articles or for articles that can be easily attached to a conveyor belt arrangement and moved in and out of a coating solution. However, for a small spherical particle it would not be practical, since it would be rather difficult to hold a small spherical particle and dip only the desired portion into a coating solution. One of the more practical methods for coating one half of a sphere or a definite portion of the sphere is proposed in U.S. Pat. No. 2,740,375 which issued to W. H. Diehl, et al. This patent proposes a method wherein the spherical particle is held between two adjacent discs with one of the discs having an opening cut out over the spherical particle so that the exposed area of the spherical particle can be sprayed. Although this approach seems to have practical application to larger sized spheres, it would be somewhat impractical for the large number of small spherical particles required in a single magnetic particle display panel. Although many of the prior art methods appear to have application for their intended purpose, none of them lend themselves to properly coating or coloring large numbers of small particles.

In view of the foregoing, it should now be understood that it would be desirable to provide an improved method for treating the surface of small particles that would solve the above and other problems.

Accordingly, one of the objects of the present invention is to provide an improved method for coating or coloring a definitely defined area of a small article so that a sharply visible transition is readily apparent between the coated and uncoated areas.

Another object of the invention is to provide an improved method for coloring a predetermined well defined area of a magnetized small spherical particle.

Yet another object of the present invention is to provide an improved method for coloring a desired portion of a small article which takes advantage of the surface tension of the treating solution on which to support the small article.

SUMMARY OF THE INVENTION

In carrying out the above and other objects of the invention in one form, I provide an improved method for use in coating, etching, or coloring a portion of the surface of small articles. One version of my method involves sprinkling or depositing a plurality of small articles onto the surface of a coloring solution. The coloring solution supports the small articles to prevent the articles from becoming fully submerged in the coloring solution. The small articles are then removed from the coating solution having only the portion that was in contact with the coloring solution colored. This provides a well defined transition from the uncolored portion of the small article to the colored portion.

Where the small articles are magnetizable a magnet can be placed over the articles as the articles are supported by the coloring solution and removed from the coloring solution in this manner. The magnet will attract the small articles and lift them out of the coloring solution.

Although the terms coating or coloring are predominantly used herein, it will be understood that such terms are intended to encompass coloring, coating, etching, silvering or any process used to render a portion of the surface of a small particle distinguishable from adjacent portions of the same particle.

The subject matter which I regard as my invention is set forth in the appended claims. The invention itself, however, together with further objects and advantages thereof, may be better understood by referring to the following detailed description taken in conjunction with the accompanying drawings.

The exemplifications set out herein illustrate the preferred embodiments of the invention in one form thereof, and such exemplifications are not to be construed as limiting in any manner.

DESCRIPTION OF THE PREFERRED EMBODIMENTS

In general, the method for coloring a portion of the surface of small articles comprises sprinkling or placing the small articles onto the surface of a coloring or coating solution. The small articles are supported on the coloring solution by the surface tension of the solution. The surface tension can be adjusted by adding surfactants, such as soap, so that the desirable fraction or portion of the article is submerged. Of course, it will be recognized that the buoyancy force acting upon the article provides some support to the article. However, it is believed that the surface tension provides the majority of the support to the article. The article is then removed from the coloring solution and is dried if desired. The article is uniformly colored over the portion of the article that was in contact with the coloring solution. The transition between the uncolored portion and the colored portion is sharply defined since the line where the coloring solution contacts the article and where it does not contact the article is well delineated.

Figure 1:
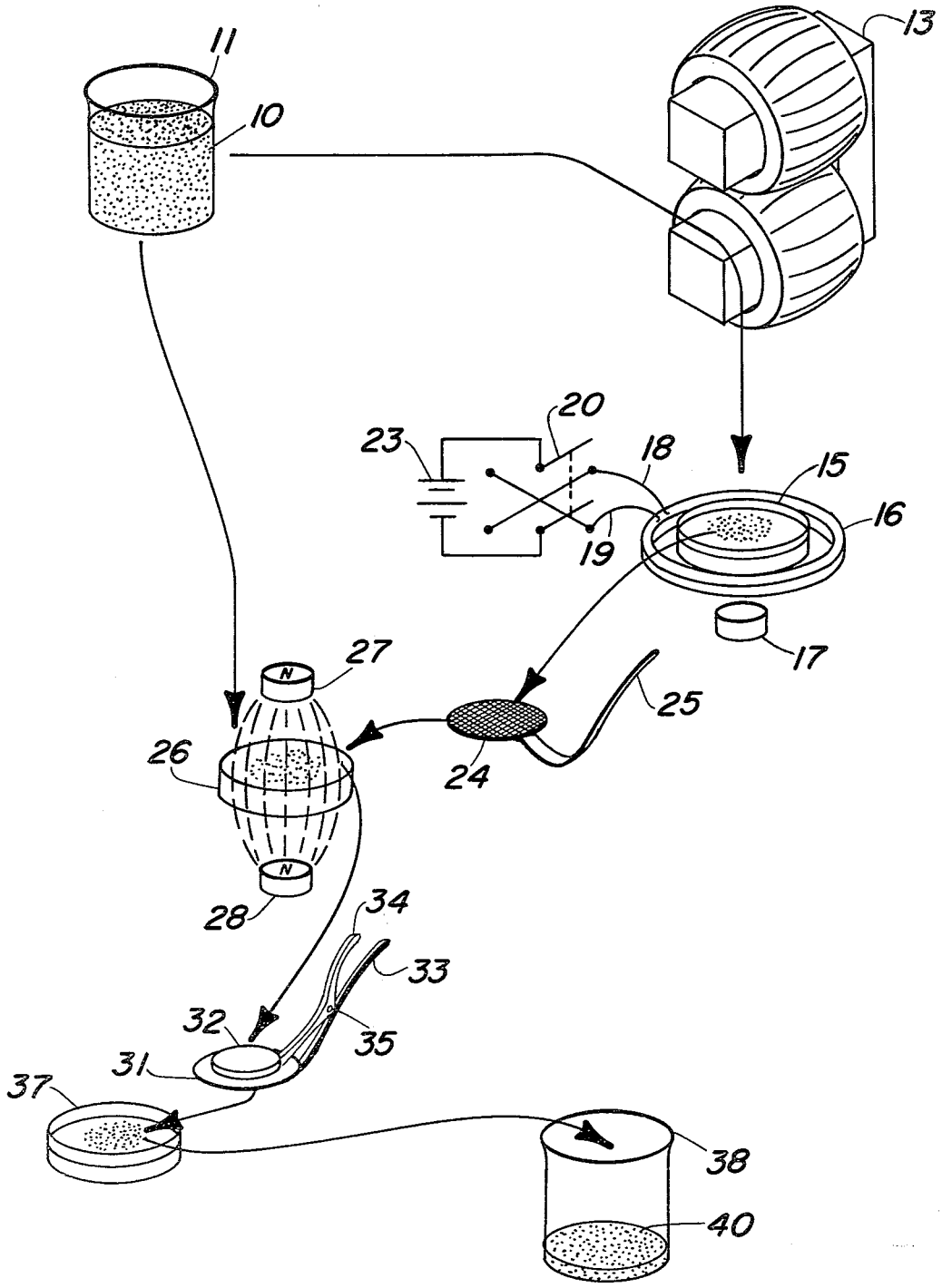
FIG. 1 is a schematic illustration of two alternate processes that may be followed in practicing my invention.

In FIG. 1 the small magnetizable spherical particles 10 are initially in container 11 and are then passed between the two poles of electromagnet 13. In magnetizing particles 10, they become polarized so that there is a definite north and south pole associated with each spherical particle. The particles are then placed in a petri dish 15. The particles will tend to cluster in petri dish 15 since the opposite poles of the different particles will attract each other and form one large cluster. A Helmholtz coil 16 is used in conjunction with a permanent magnet 17 to create a nonuniform magnetic field in order to disperse the cluster of small magnetized spherical particles. Coil 16 has lead wires 18 and 19 which are connected to a double-pole double-throw switch 20 which is wired for reversing direction of electric current flow through coil 16. Switch 20 is connected to a voltage source such as battery 23. With switch 20 in one position coil 16 will generate a fairly uniform magnetic field. However, permanent magnet 17 located at the axis of coil 16 also has a magnetic field associated with it and is used to create a total magnetic field that is nonuniform when coil 16 is energized. The magnetic field is stronger near the axis of coil 16 if coil 16 and permanent magnet 17 are producing magnetic fields in the same direction. When coil 16 is producing a magnetic field that is opposite in direction to the magnetic field of permanent magnet 17 then, of course, the magnetic field is weaker near the axis of coil 16. By switching switch 20 from one position to the other, the direction of the magnetic field produced by coil 16 can be controlled. The number of times that the magnetic field of coil 16 needs to be reversed depends upon how easily the cluster of magnetized particles disperse. If just a few weakly magnetized magnetic particles are in petri dish 15, then perhaps one reversal would be sufficient.

Once the particles are dispersed and coil 16 is deenergized, the dispersed or separated magnetic particles will tend to gather near the axis of the magnetic field produced by permanent magnet 17, however, the particles will not cluster or be attracted to each other since they will each individually be aligned with the magnetic field of magnet 17 and thereby create a repulsive force causing the particles to repel each other. Since the particles are all gathered in one localized area, they can be easily lifted with an appropriate scoop such as mesh 24 which is attached to a handle 25. The mesh does not have to be finer than the particles, when the particles are dispersed on the surface of a liquid, since the liquid will span the mesh openings and the surface tension of the liquid will support the particles as they are transported by the mesh. Accordingly, it will be understood that a mesh or other type of porous material can be used in transferring the dispersed particles.

It has been found preferable to have a liquid such as water in petri dish 15 upon which the small magnetized spherical particles can be supported. This allows a low friction surface for the magnetic particles and therefore the particles can rotate easily to align themselves with the changing magnetic fields. Also, mesh 24 is easily slipped into the liquid below the gathered magnetic particles permitting the particles to be easily lifted up out of petri dish 15. The small particles or articles are then transported to petri dish 26 which contains a coloring or coating solution. Permanent magnets 27 and 28 generate a magnetic field through petri dish 26 and as mesh 24, carrying the particles, enters the field, the particles align themselves with the magnetic field produced by magnets 27 and 28 so that as mesh 24 is lowered into the coloring solution in petri dish 26 a predetermined pole of the magnetic sphere comes in contact with the coloring solution. In this manner, the portion of the spherical particle that is coated or colored is associated with a predetermined magnetic pole of the spherical particle. As wire mesh 24 is lowered into the coloring solution in petri dish 26, the particles will be supported by the surface tension at the interface between air and the coloring solution. Once the particles are supported by the surface tension wire mesh 24 can be removed from dish 26. Instead of air, a different fluid can be used to form the interface between the fluid and the treating solution. In some applications it may be desirable to use an inert gas instead of air.

The magnetic particles are removed from dish 26 by placing a flat disc 31 made of a nonmagnetic material over the magnetic particles. On top of disc 31 is a permanent magnet 32 which attracts the magnetic particles so that the magnetic particles are abutted against disc 31. As disc 31 is removed away from petri dish 26 the magnetic particles are lifted off of the coloring solution. Disc 31 has a handle 33 while permanent magnet 32 has a handle 34 which is attached to handle 33 by pivot or hinge 35. The colored particles can then be washed in a neutralizing solution such as acetone or alcohol in container 37. The colored particles are allowed to remain abutted to disc 31 by the attraction of magnet 32 until the particles are dry. The particles can be allowed to dry at room temperature or can be dried in an oven or by any other suitable means. Once the particles are dry, handle 34 can be pressed toward handle 33 thereby lifting magnet 32 away from disc 31 allowing the colored particles 40 to fall into a receptacle such as container 38. Although the above process has been described in terms of using petri dishes, it will be understood that other containers can be used. In a production line, large containers or troughs may be required.

If the articles 10 in container 11 do not require magnetization and dispersion, then they can be sprinkled directly from container 11 onto the coloring solution in petri dish 26. The articles could be removed from the coloring solution in disc 26 by a wire mesh 24 since the surface tension of the coloring solution contained by the wire mesh would support the small articles. However, it will be appreciated that by the use of disc 31 and magnet 32 the articles can be lifted from the coloring solution without touching the portion that has just been colored and the articles can be held in this manner until they are dry. In many cases, the coloring solution will be soft and easily rubbed off if the articles are handled by the newly colored portion of the articles.

Figure 2:
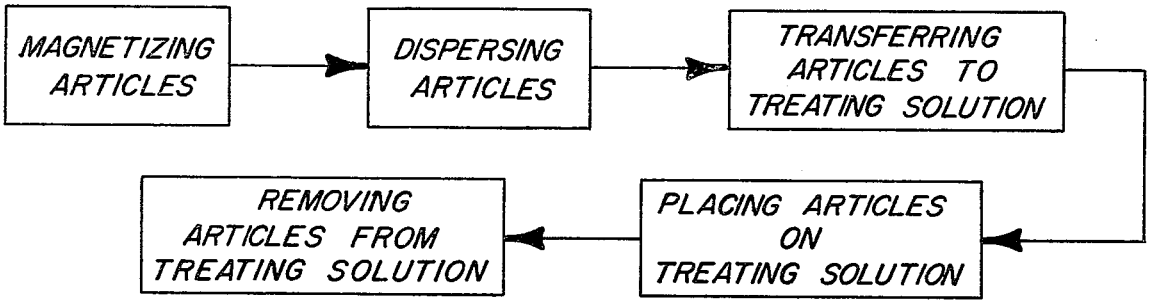
FIG. 2 illustrates in block diagram form the steps that can be followed in performing one embodiment of the invention.

FIG. 2 illustrates, in block diagram form, the steps performed in treating a portion of the surface of magnetizable articles. The method comprises magnetizing articles, dispersing the articles, then transferring the articles to a treating solution, placing the articles on the treating solution where the articles are supported by surface tension between the air-liquid interface of the solution, and then removing the articles from the treating solution.

Figure 3:
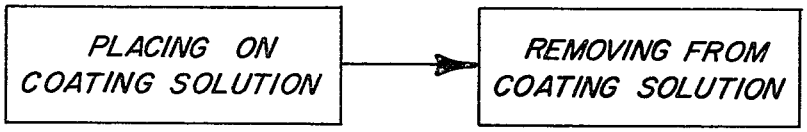
FIG. 3 illustrates in block diagram form a condensed version of the method of the invention.

FIG. 3 illustrates in block diagram form a condensed version of a procedure for coloring small nonmagnetic articles. First the articles are placed on the coloring solution so that they are supported by the surface tension between the surface-air interface of the coloring solution and then the articles are removed from the coloring solution thereby being colored only on the portion of the articles that comes in contact with the coloring solution. This method can be followed when coating or coloring only a portion of a small nonmagnetic article.

Figure 4:
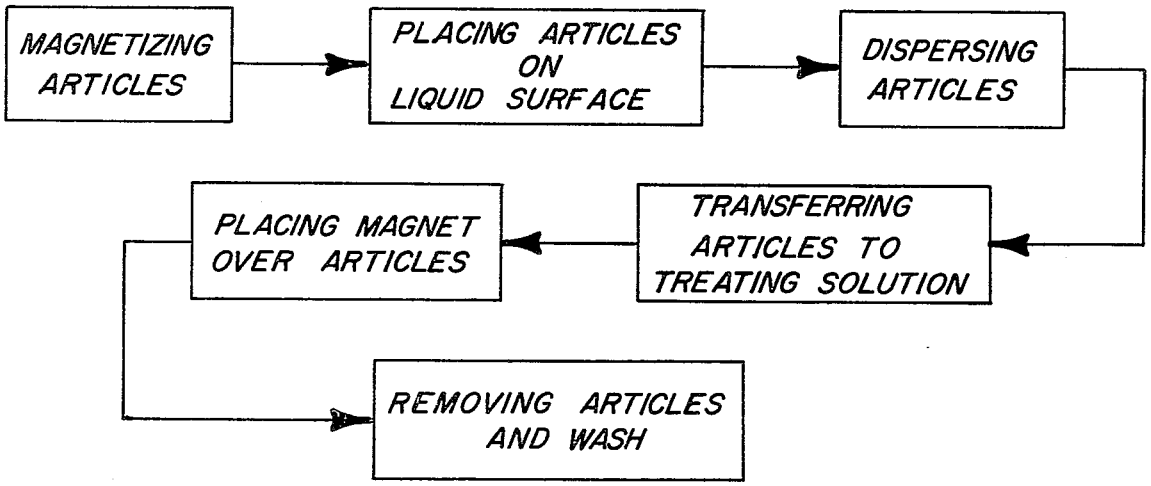
FIG. 4 illustrates in block diagram form steps that can be followed in performing another embodiment of the invention.

FIG. 4 illustrates in block diagram form another method that can be followed in treating a portion of magnetized articles. First the articles are magnetized, and then they are placed on a liquid-air interface surface where the articles are supported substantially by surface tension. On the liquid-air interface surface the articles are dispersed by generating a field first in one direction and then in an opposite direction through the liquid. Once the articles are dispersed, they are then transferred to a coating solution and placed on the surface of the coating solution. A magnet is then placed over the articles and lifted up, thereby removing the articles from the surface of the coating solution. The articles can then be washed and dried.

In one process followed to color a portion of strongly magnetized particles, the particles were first exposed to a magnetic field of 5000 gauss. The particles were then placed on an air-water interface surface where they were supported substantially by surface tension. The particles having a specific gravity of about 1.5 would not normally float, however, the particles were small enough and the surface tension was strong enough to support the particles on the air-water interface. The water was contained in a petri dish of about 5 centimeters in diameter and was placed inside a Helmholtz coil of about 10 centimeters in diameter. In the axis of the coil and under the petri dish was placed a permanent magnet of about 100 gauss. The Helmholtz coil was energized to produce a uniform field of about 500 gauss, however, the interaction of the magnetic field from the Helmholtz coil and the field from the permanent magnet created a nonuniform magnetic field. Electric current through the Helmholtz coil was reversed several times thereby causing the clustered particles to disperse. The Helmholtz coil can be de-energized when the two magnetic fields are additive or the coil can be left energized when the fields are additive. In either case, since the strongest field was near the permanent magnet, the particles aligned magnetically with this strongest field and tended to group in this field. However, since each particle was aligned, a repulsive force was created between the particles and therefore they no longer formed clusters or magnetically attached to each other. Thus, the particles were slightly separated from each other. The small articles were then moved to another small dish containing a silvering solution. Again the small articles were supported by the surface tension of the air-liquid interface of the silvering solution. The particles were left on the surface long enough to allow the portion of the particle in contact with the silvering solution to be silvered. A rubber magnet was then placed on top of a flat nonmagnetic (stainless steel) disc and the flat nonmagnetic disc was lowered to be just above the small articles. The rubber magnet on top of the flat nonmagnetic disc attracted the small articles through the nonmagnetic disc thereby lifting them from the silvering solution. The partially colored small articles were then washed in a small dish containing acetone. The particles were then allowed to air dry overnight. It was found that if the coated articles were not washed shortly after removing them from the silvering solution, that the silver would tarnish and result in a brown tarnished finish on the article. For use in a magnetic particle display panel it is desirable to have a bright highly reflective surface over a portion of the article.

Nonmagnetized particles or weakly magnetized particles such as particles that have not been exposed to over 1000 gauss do not tend to cluster up as do particles that have been strongly magnetized. Therefore, these articles could be sprinkled directly onto the coating solution without need for performing the dispersion and transfer steps. It should be noted however that if a portion of the article associated with the predetermined magnetic pole is desired to be coated that a magnetic field should be maintained through the coating solution so that the particles will align themselves with such a magnetic field. The generated magnetic field should be strong enough to overcome the surface tension forces thereby permitting the articles to align themselves with the magnetic field so that the desired portion of the article becomes coated. In some cases, the magnetic field can be used to assist the surface tension in supporting the article.

Those persons skilled in the art will recognize that the function of the magnetic fields used herein can be accomplished by the use of an electro-static field for articles having electric charges or dipole moments.

It will now be appreciated that I have provided a novel method for coating a portion of the surface of a plurality of small articles. Although my method was developed primarily for the purpose for making one hemisphere of a small spherical particle reflective for use in my magnetic particle display panel, it will be appreciated that this same method can be used for other particles that are small enough or of a low enough density so that they can be supported on the liquid surface by surface tension or the combination of surface tension and buoyancy.

An alternate process that can be followed is to color a greater portion of the particle than needed and then to place the particle on the surface of an etching solution. The etching solution then removes the colored portion of the particle that is in contact with the etching solution thereby leaving the remainder of the particle colored. This permits etching only the desired portion of the particle and yields a sharp transition or terminator between the colored and uncolored portions of the particle.

As explained hereinbefore, there exists shortcomings in spraying a portion of an article while allowing that portion of the article to serve as a mask for the remainder of the article. This shortcoming is easily overcome by placing the small articles to be sprayed on the surface of a liquid and then spraying the portion of the articles that is not in contact with the liquid. Surfactants can be added to the liquid to control the liquid's surface tension thereby controlling the amount or portion of the article that is in contact with the liquid.

In some applications it may be desirable to support the small articles on a liquid surface and then to cover the small articles with a surface treating solution to treat the portion of the surface of the articles that is not in contact with the supporting liquid. In such a case, the interface surface will be a liquid-to-liquid interface surface. Alternatively, the treating solution can also be the supporting solution and another liquid poured over the articles thus forming the liquid-to-liquid interface.

Consequently, while in accordance with the Patent Statutes, I have described what at present are considered to be the preferred forms of my invention it will be obvious to those skilled in the art that numerous changes and modifications may be made herein without departing from the spirit and scope of the invention, and it is therefore aimed in the following claims to cover all such modifications.

What I claim as new and desire to secure by Letters Patent of the United States is:

1. A method for coating only a portion of a plurality of substantially spherical particles to provide a sharp delineation between the coated and uncoated portion of the particle, comprising: sprinkling a plurality of substantially spherical particles onto a surface of a coating solution, the coating solution supporting the particles substantially by adjustable surface tension to prevent the particles from becoming fully submerged in the coating solution; and removing the particles from the coating solution, the particles being coated only on the portion of the particle in contact with the coating solution.

2. The method of claim 1 wherein the particles are magnetizable and further comprising generating a magnetic field through the coating solution so that preselected portions of the particles are aligned with the magnetic field.

3. The method of claim 2 further comprising placing a magnet over the particles as the particles are supported by the coating solution to attract the particles to the magnet thereby removing the spherical particles from the coating solution.

4. A method of treating only a portion of a substantially spherical magnetizable particle, comprising: generating a magnetic field through a treating solution having an adjustable surface tension of sufficient strength in combination with specific gravity to support the particle; placing a plurality of particles upon the treating solution, the treating solution supporting the particles and preventing the particles from becoming totally submerged into the treating solution, the particles being treated only over an area that comes in contact with the treating solution; and removing the particles from the treating solution.

5. The method of claim 4 further including placing a magnet over the particles to attract the particles to the magnet to perform removal of the particles from the treating solution.

6. A method of uniformly coating a portion of a magnetizable spherical particle, comprising: magnetizing a plurality of the particles, placing the plurality of particles on a liquid surface; generating a magnetic field of a first polarity around the liquid to cause the particles to become aligned with the magnetic field of the first polarity; de-energizing the magnetic field of the first polarity; generating a magnetic field of a second polarity, the second polarity being opposite from the first polarity thereby causing the particles to re-align with the magnetic field of the second polarity and repeating generating the magnetic field of the first and second polarity until the magnetized particles are dispersed; transferring the particles to a coating solution having an adjustable surface tension that supports the particles to prevent the particles from becoming totally submerged in the coating solution; and removing the particles from the coating solution.

7. The method of claim 6 further including washing the particles in a neutralizing solution.

8. A method of treating only a portion of an article, comprising: placing a plurality of articles on a surface of a treating solution where the articles are supported by a combination of buoyancy and adjustable surface tension so that only the portion of the article in contact with the treating solution becomes treated with said treating solution; removing the plurality of articles from the treating solution; and drying the plurality of articles.

9. A method of coating only a portion of a magnetizable article, comprising: magnetizing a plurality of the magnetizable articles; generating a magnetic field through a coating solution to align poles of the magnetizable articles with the magnetic field; placing the plurality of articles on the coating solution so that only the portion of the articles in contact with the coating solution becomes coated; the coating solution having an adjustable surface tension for buoyantly supporting the articles; and removing the plurality of articles from the coating solution.

10. The method of claim 9 further including dispersing the plurality of articles prior to placing the articles on the coating solution, the dispersing being accomplished by placing the articles in a reversible nonuniform magnetic field and changing polarity of the nonuniform magnetic field at least once.

11. The method of claim 10 further including placing the plurality of articles on an air-liquid interface surface to assist in movement of the articles during the dispersing.

12. The method of claim 9 wherein the removing of the articles from the coating solution is performed by placing a magnet over the plurality of articles on the coating solution so that the articles are attracted by the magnet and lifted off the coating solution.

13. The method of claim 9 further including washing the articles after removal from the coating solution.

14. A method of treating only a portion of a magnetizable article, comprising: magnetizing the magnetizable article; placing a plurality of articles in a container, the container having a magnet placed near the center of the container and an electrical coil surrounding the container; energizing the electrical coil to produce a magnetic field first in one direction and then in an opposite direction thereby creating a nonuniform field within the container by the interaction between magnetic fields of the magnet and electrical coil; transferring the plurality of articles from the container to a treating solution and placing the articles on the treating solution so that only that portion of the articles in contact with the treating solution becomes treated; the treating solution having an adjustable viscosity for buoyantly supporting the article; and removing the articles from the treating solution.

15. A method of coloring only a portion of a magnetizable spherical particle of less than 200 microns in diameter, comprising: magnetizing the spherical particles; dispersing the spherical particles by generating a reversible nonuniform magnetic field around the spherical particles; transferring the dispersed spherical particles to a coloring solution where the particles are supported substantially by adjustable surface tension and thereby colored only on that portion of the particle in contact with the coloring solution; and removing the particles from the coloring solution by attracting the particles magnetically off the coloring solution.

16. A method of etching only a portion of a colored article so that the etched portion appears of a different color than a portion that is not etched, comprising: supporting the particle on a surface of a fluid-liquid interface so that only a portion of the particle is in contact with an etching solution, the supporting being accomplished by adjustable surface tension of the fluid-liquid interface and assisted by buoyancy of the article; and removing the article from the fluid-liquid interface after the etching has been completed.

17. A method of treating only a portion of an article so that the article will exhibit different colors between the treated and untreated portions, comprising: placing a plurality of the articles on a liquid-liquid interface surface so that the articles are treated by a treating solution contained in one of the liquids forming the liquid-liquid interface; supporting the articles on the interface surface mainly by adjustable surface tension with assistance from buoyancy of the article; and removing the article from the liquid-liquid interface after the portion of the article has been treated.

18. A method of surface treating only a portion of a surface of a small article so that the treated surface exhibits a different color than an adjacent untreated surface, comprising: placing at least one article on a liquid; supporting the at least one article on the liquid by adjustable surface tension assisted by buoyancy; surface treating only that portion of the surface of the at least one article in contact with the treating solution; and removing the at least one article from the liquid.

* * * * *